US011002083B2

(12) United States Patent
Chang

(10) Patent No.: US 11,002,083 B2
(45) Date of Patent: May 11, 2021

(54) DOWNHOLE MOTOR THAT IMPROVED THREAD FASTENING STRUCTURE

(71) Applicant: SANDONG METAL INDUSTRY, Gumi-si (KR)

(72) Inventor: Suk Soo Chang, Daegu (KR)

(73) Assignee: SANDONG METAL INDUSTRY, Gumi-si (KR)

( * ) Notice: Subject to any disclaimer, the term of this patent is extended or adjusted under 35 U.S.C. 154(b) by 0 days.

(21) Appl. No.: 16/927,188

(22) Filed: Jul. 13, 2020

(65) Prior Publication Data

US 2021/0010331 A1 Jan. 14, 2021

(30) Foreign Application Priority Data

Jul. 12, 2019 (KR) ..... 10-2019-0084436

(51) Int. Cl.
*E21B 17/03* (2006.01)
*E21B 17/043* (2006.01)

(52) U.S. Cl.
CPC ..... *E21B 17/03* (2013.01); *E21B 17/043* (2013.01)

(58) Field of Classification Search
CPC ..... E21B 7/068; E21B 17/03
See application file for complete search history.

(56) References Cited

U.S. PATENT DOCUMENTS 4,560,014 A * 12/1985 Geczy ..... E21B 4/00 175/107
6,092,612 A * 7/2000 Brady ..... E21B 10/60 175/325.2
6,439,321 B1 * 8/2002 Gillis ..... E21B 7/068 166/117.5
2007/0256865 A1 * 11/2007 Cruickshank ..... E21B 7/068 175/61
2016/0290411 A1 * 10/2016 Chustz ..... E21B 4/006
2017/0130538 A1 * 5/2017 In ..... E21B 3/02
2018/0258999 A1 * 9/2018 Liess ..... E21B 41/00
2020/0003009 A1 * 1/2020 Caresta ..... E21B 10/42
2020/0124108 A1 * 4/2020 Goff ..... E21B 17/03

FOREIGN PATENT DOCUMENTS

KR 10-2017-0005445 A 1/2017
KR 10-2018-0052760 A 5/2018
KR 10-1958139 B1 3/2019

* cited by examiner

*Primary Examiner* — Shane Bomar
(74) *Attorney, Agent, or Firm* — Novick, Kim & Lee, PLLC; Jae Youn Kim

(57) ABSTRACT

A downhole motor having an improved thread fastening structure is proposed. In the downhole motor, a thread structure disposed therein and having ridges formed at both end portions at a predetermined distance from ends is improved and the internal structures of a first coupler and a second coupler in which the end portions of the thread are respectively inserted and fastened are improved to correspond to the end portions of the thread, thereby being able to improve sealing ability.

4 Claims, 5 Drawing Sheets

DOWNHOLE MOTOR THAT IMPROVED THREAD FASTENING STRUCTURE

CROSS-REFERENCE TO RELATED APPLICATIONS

The present application claims priority to Korean Patent Application No. 10-2019-0084436, filed on Jul. 12, 2019, the entire contents of which is incorporated herein for all purposes by this reference. This present invention is based on the work supported by Korea Agency for Infrastructure Technology Advancement grant funded by Ministry of Land, Infrastructure and Transport (20IFIP-B133621-04, Development of directional mud motor and direction control technology of drilling system).

TECHNICAL FIELD

The present invention relates to a downhole motor having an improved thread fastening structure and, more particularly, to a downhole motor in which a thread structure disposed therein and having ridges formed on both end portions at a predetermined distance from ends is improved and the internal structures of a first coupler and a second coupler in which the end portions of the thread are respectively inserted and fastened are improved to correspond to the end portions of the thread, thereby being able to improve sealing ability.

BACKGROUND ART

In general, a directional motor is a drilling instrument that can bore while 3-dimensionally changing the route and direction to the target point under the ground and is generally used mainly in North America, but it is increasingly required to develop an independent technology even in our country due to an increase of the oil industry and construction f various pipelines.

As inventions related to a directional motor in the related art, Korean Patent Application Publication No. 10-2017-0005445, titled "mud motor transmission", Korean Patent Application Publication No. 10-2018-0052760, titled "steel alloy with high strength, high impact toughness and excellent fatigue life for mud motor shaft applications", and Korean Patent No. 10-1958139, titled "a mud motor having a power transmission" have been proposed and published.

In Korean Patent Application Publication No. 10-2017-0005445, titled "mud motor transmission", an invention related to an apparatus that includes a new coupling allowing for transmission of torsion energy and can substantially remove or reduce angular changes generated in input shafts by allowing for transmission torsion energy from one shaft to another shaft and receiving arrangements of eccentric or parallel offset shafts has been proposed; In Korean Patent Application Publication No. 10-2018-0052760, titled "steel alloy with high strength, high impact toughness and excellent fatigue life for mud motor shaft applications", an invention relates to a compound that enables deeper drilling by providing a strong shaft material having not only high impact toughness, but also an excellent rotation buckling fatigue lifespan has been proposed; and In Korean Patent No. 10-1958139, titled "a mud motor having a power transmission", an invention related to an apparatus that enables smooth power transmission by including a connector that has a cylindrical shape with open top and bottom and is installed between a driving shaft and a bit shaft such that the upper portion thereof is coupled to the driving shaft and the lower end thereof is coupled to a driven bearing groove formed on the inner surface of the bit shaft has been proposed.

However, according to these inventions in the related art, there is a problem that a small amount of mud that is delivered may leak due to poor coupling between a thread and another part or structural limitation, so Teflon tape is wound around the ridges of the thread and epoxy is applied to solve the problem, but in this case, there is a problem that costs are increased and the work process becomes complicated.

Therefore, it is required to develop an apparatus that can prevent leakage of mud due to poor coupling between a thread and another part or structural limitation and can prevent generation of costs and complication of the work process due to applying Teflon tape and applying epoxy.

The description provided above as a related art of the present invention is just for helping understanding the background of the present invention and should not be construed as being included in the related art known by those skilled in the art.

DOCUMENTS OF RELATED ART

[Patent Documents]

(Patent Document 1) Korean Patent Application Publication No. 10-2017-0005445 (Jan. 1, 2017);

(Patent Document 2) Korean Patent Application Publication No. 10-2018-0052760 (May 18, 2018); and (Patent Document 3) Korean Patent No. 10-1958139 (Mar. 7, 2019).

DISCLOSURE

Technical Problem

The present invention has been made in an effort to solve the problems described above and an objective of the present invention is to provide a downhole motor having an improved thread fastening structure that has an improved sealing ability by proposing a solution about the problem in the related art that mud that is delivered therein leaks due to poor coupling between a thread and another part or structural limitation and the problem that although it is possible to wind Teflon tape around the ridges of the thread and apply epoxy to the thread to sufficiently seal the thread, but in this case, costs are generated and the work process becomes complicated due to Teflon tape and epoxy.

Technical Solution

In order the achieve the objectives, a downhole motor having an improved thread fastening structure according to the present invention includes: a thread having a hole therein formed through a first end and a second end and having ridges formed on outer surfaces of a first end portion and a second end portion at predetermined distances respectively from the first end and the second end; a first coupler having a mud inlet formed with a predetermined depth from a first end, having a first close-contact surface and first grooves that are sequentially formed from the inlet to correspond to the first end portion of the thread, and having a first coupling inlet formed from the first grooves to a second end to insert the thread therein; and a second coupler having a second coupling inlet formed with a predetermined depth from a first end to insert the thread therein, and having second grooves and a second close-contact surface sequentially formed from the second coupling inlet to a second end to correspond to the second end portion of the thread.

Advantageous Effects

According to the downhole motor having an improved thread fastening structure of the present invention, the structure of the thread is improved by forming ridges formed on both end portions of the thread at a predetermined distance from ends and the structures is improved by forming grooves and close-contact surfaces corresponding to end portions of the thread are formed in each of a first coupler and a second coupler in which the thread is inserted and fastened. Accordingly, there is an effect that it is possible to prevent leakage of mud due to poor fitting of ridges and grooves or structural limitation. Accordingly, it is not required to use Teflon tape and epoxy for improving a sealing ability, so there is an effect that it is possible to prevent complication of a work process.

The objectives, features, and other advantages of the present invention will be clearly understood from the detailed description referring to the accompanying drawings.

DESCRIPTION OF DRAWINGS

The above and other objectives, features and other advantages of the present invention will be more clearly understood from the following detailed description when taken in conjunction with the accompanying drawings, in which.

DETAILED DESCRIPTION OF THE INVENTION

Figure 1:
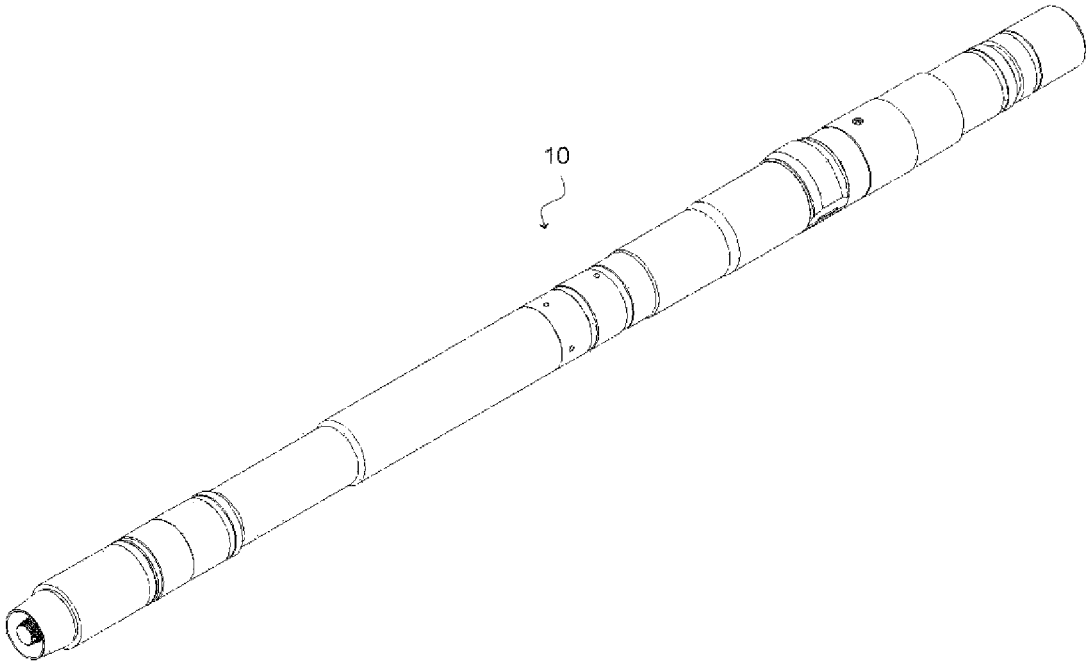
FIG. 1 is a perspective view showing the external appearance of a downhole motor having an improved thread fastening structure according to the present invention.

The present invention relates to a downhole motor having an improved thread fastening structure, which includes:

a thread 100 having a through-hole therein formed through a first end and a second end and having ridges 102 formed on the outer surfaces of a first end portion and a second end portion at predetermined distances respectively from the first end and the second end;

a first coupler 110 having a mud inlet 111 formed with a predetermined depth from a first end, having a first close-contact surface 112 and first grooves 113 that are sequentially formed from the inlet 111 to correspond to the first end portion of the thread 100, and having a first coupling inlet 114 formed from the first grooves 113 to a second end to insert the thread 100 therein; and a second coupler 120 having a second coupling inlet 121 formed with a predetermined depth from a first end to insert the thread 100 therein, and having second grooves 122 and a second close-contact surface 123 sequentially formed from the second coupling inlet 121 to a second end to correspond to the second end portion of the thread 100.

Hereinafter, embodiments of the present invention are described in detail with reference to the accompanying drawings.

Figure 2A:
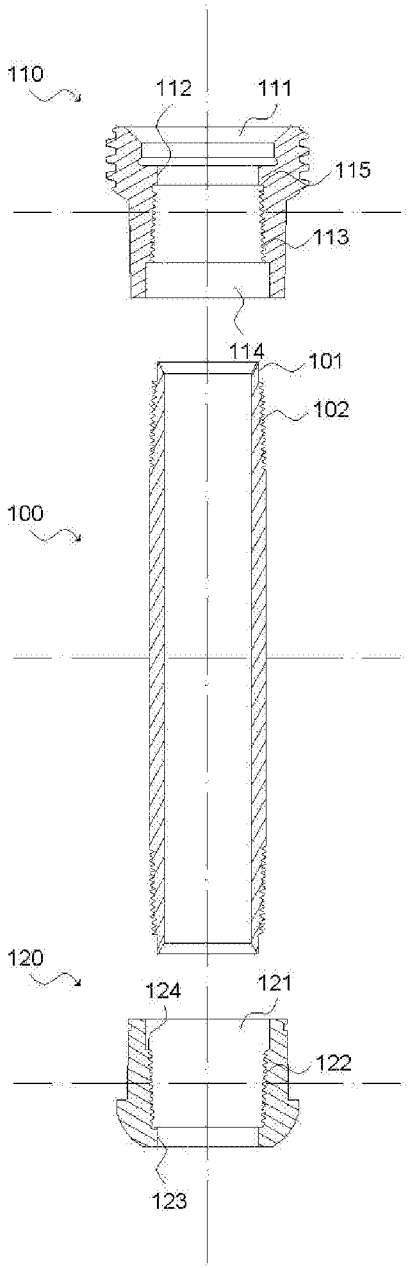
FIGS. 2A and 2B are exemplary views showing that a first coupler and a second coupler are coupled to an end and another end, respectively, of the thread of a downhole motor having an improved thread fastening structure.
Figure 2B:
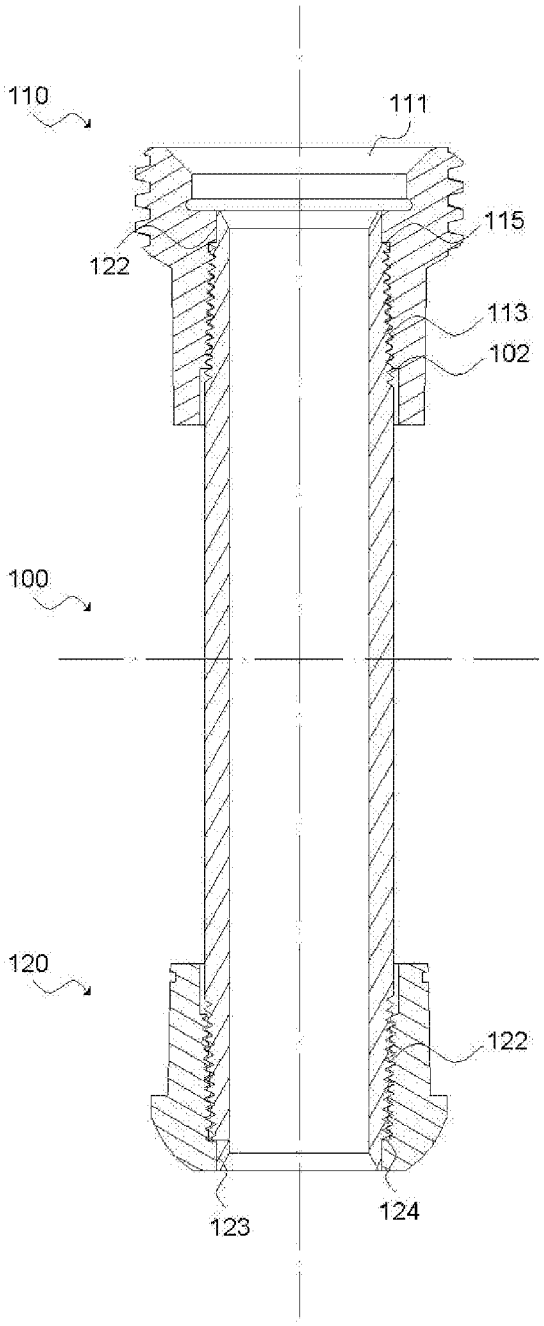

First, the thread 100, as shown in FIG. 1, is a part disposed in the downhole motor 10 and transmitting power by connecting the first coupler 110 and the second coupler 120, and may be a National Pipe Thread (NPT) of several well-known threads that have a through-hole therein formed through a first end and a second end and have ridges 102 on the outer surfaces of a first end portion and a second end portion, as shown in FIGS. 2A and 2B.

Accordingly, the thread 100 is coupled to the first coupler 110 and the second coupler 120 by the ridges 102 formed on the outer surfaces of the first end portion and the second end portion thereof, thereby being able to transmit power from the first coupler 110 to the second coupler 120 and enable mud to be delivered through the through-hole.

The ridges 102 on the first end portion of the thread 100 are formed at a predetermined distance from the first end of the thread 100 and the ridges 102 on the second end portion of the thread 100 are also formed at a predetermined distance from the second end of the thread 100. Accordingly, contact portions 101 that have a flat surface because the ridges 102 are not formed can be formed with the same lengths and areas on both end portions of the thread 100.

However, the ridges 102 bordering on the contact portions 101 at both end portions of the thread 100 may not have the same lengths and areas, so the lengths and areas of the ridges 102 can be changed in accordance with the lengths and areas of the grooves 113 and 122 formed in the first coupler 110 and the second coupler 120, respectively.

The contact portions 101 are formed to secure sufficient sealing ability by solving problems that are generated when common ridges and grooves are fitted to each other, and it may be possible to form the ridges 102 by forming ridges 102 on the entire first end portion and second end portion and then milling some of the ridges 102.

Figure 3:
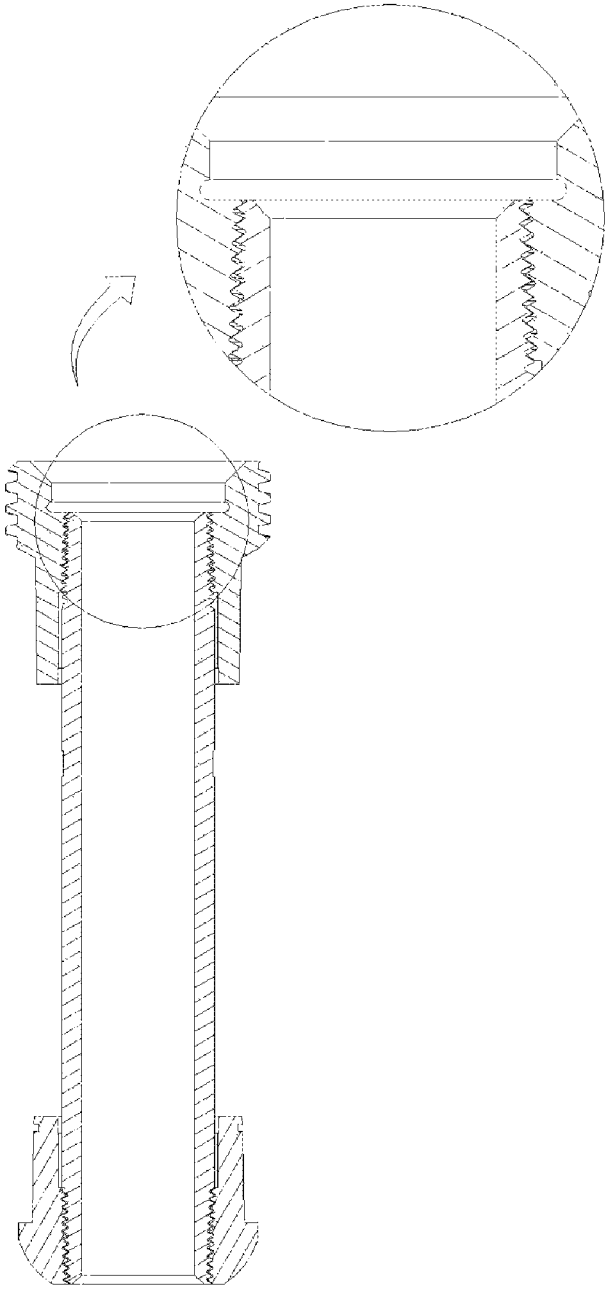
FIG. 3 PRIOR ART
FIG. 3 is a cross-sectional view showing a coupling state of a thread in the related art.

That is, in a common case in which ridges are fitted to grooves, there is a possibility of substances having fluidity such as fluid flows into the grooves along the ridges. Therefore, according to a thread of the related art in which ridges are formed on the entire first end portion and second end portion, as shown in FIG. 3, it is required to secure a sufficient sealing ability in order to prevent leakage of fluid by winding Teflon tape on the ridges and apply epoxy to the ridges.

However, according to this method, there is a problem that costs are required to purchase Teflon tape and epoxy, the work process becomes complicated, and some pieces of Teflon tape may enter an apparatus. Accordingly, the present invention provides an effect that it is possible to secure a sufficient sealing ability even through the structure without the work process of winding Teflon tape on the ridges 102 and applying epoxy to the ridges 120 by forming the contact portion at each of the first end portion and the second end portion of the thread 100.

As shown in FIGS. 2A and 2B, the first coupler 110 is a part disposed in the downhole motor 10 and transmitting power by being fastened to the first end portion of the thread 100. The first coupler 110 has the mud inlet 111 formed with a predetermined depth from the first end, has the first close-contact surface 112 and the first grooves 113 sequentially formed from the mud inlet 111 to correspond to the first end portion of the thread 100, and has the first coupling inlet 114 formed from the first grooves 113 to the second end to insert the thread 100.

Accordingly, it is possible to couple the thread 100 to the first coupler 110 by inserting the first end portion of the thread 100 into the first coupler 110 through the first coupling inlet 114, in which the contact portion 101 comes in close contact with the first close-contact surface 112 and the ridges 102 are fitted to the first grooves 113 by the external shape of the thread 100 and the internal shape of the first coupler 110 described above.

Since the length and area of the first close-contact surface 112 are the same as the length and area of the contact portion 101, when the first end portion of the thread 100 is inserted in the first coupler 110, the end should be positioned on the border between the mud inlet 111 and the first close-contact surface 112, but the lengths and areas of the first grooves 113 not having this limitation may be the same as or larger than the lengths and areas of the ridges 102.

That is, when the length and area of the contact portion 101 are larger than the length and area of the first close-contact surface 112, a portion of the contact portion 101 which does not come in close contact with the first close-contact surface 112 is inserted into the coupling inlet, whereby a circular groove that can be filled with mud is formed in the coupling inlet. Further, the mud filling the circular groove may be compressed and solidified or may be forcibly moved into the gap between the first close-contact surface 112 and the contact portion 101 and then flow out of the first coupler 110 along the ridges 102 by continuous mud inflow pressure. Further, it may be difficult to separate the thread 100 and the first coupler 110 due to the solidified mud.

Accordingly, although it is preferable that the length and area of the contact portion 101 are the same as or smaller than the length and area of the first close contact surface 112, the present invention is characterized in that the length and area of the contact portion 101 are made the same as the length and area of the first close contact surface 112 to stabilize coupling and improve fastening force between the thread 100 and the first coupler 110.

As described above, since the contact portion 101 is formed by forming ridges 102 on the entire first end portion and second end portion of the thread 100 and then milling some of the ridges, it is apparent that the thickness of the portion, on which the contact portion 101 is formed, of the first end portion of the thread 100 is decreased in comparison to the thickness of the other portion on which the ridges 102 are formed, and it is also apparent that the internal shape of the first coupler 110 should be formed to correspond to the shape of the end portion of the thread 100.

Therefore, a first stopping step 115 to which the ridges 102 of the thread 100 are locked is formed on the border between the first close-contact surface 112 and the first grooves 113, and according to this structure, the first stopping step 115 limits the depth to which the thread 100 can be inserted in the first coupler 110 at a predetermined level and further improves the sealing ability for the thread 100.

Figure 4:
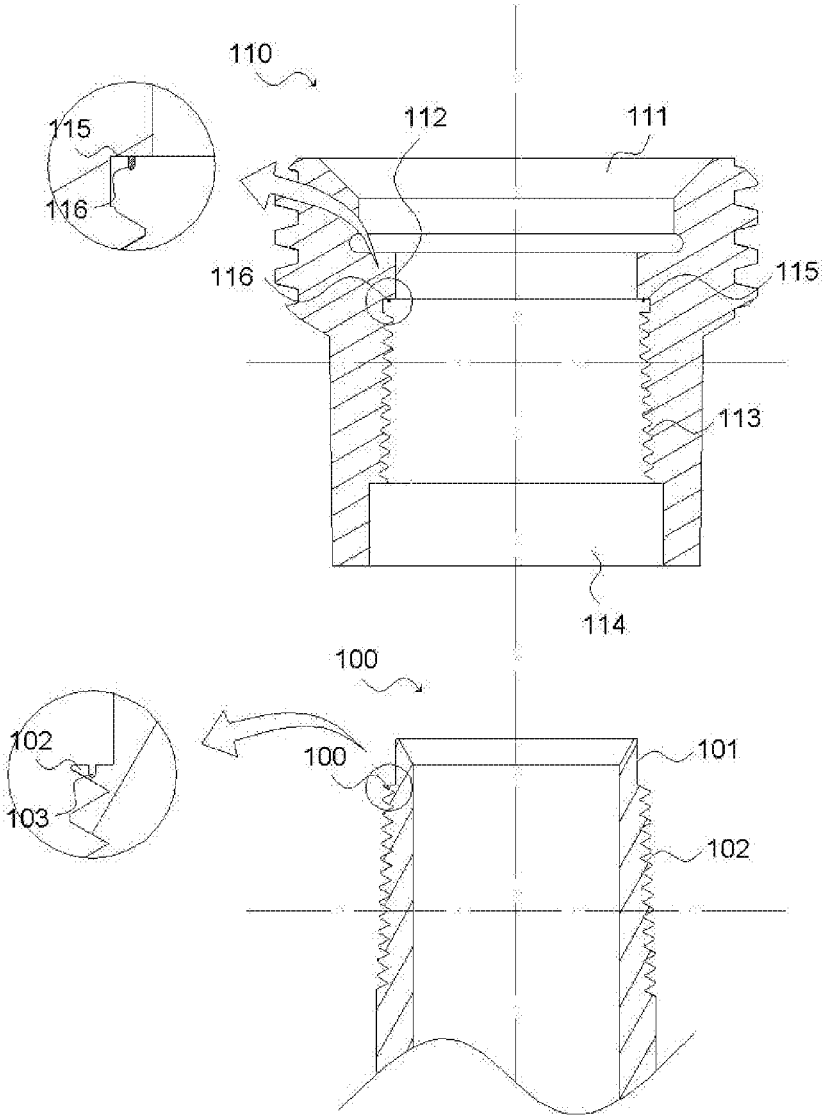
FIG. 4 is an exemplary view showing a first protrusion and a slit formed in the downhole motor having an improved thread fastening structure according to the present invention.

As shown in FIG. 4, a circular first protrusion 116 may be formed toward the first coupling inlet 114 at the first stopping step 115, and a slit 103 in which the first protrusion 116 can be fitted may be formed on a side a ridge 102 on the first end portion of the thread 100 to correspond to the first protrusion 116.

Accordingly, when the thread 100 is fastened to the first coupler 110, the first protrusion 116 is fitted into the slit 103, and this structure increases the fastening force between the thread 100 and the first coupler 110 and further improves the sealing ability for the thread 100.

That is, close contact between the contact portion 101 and the first close-contact surface 112, the first stopping step 115, and the structure in which the first protrusion 116 is fitted in the slit 103 are factors that triply improve the sealing ability for the thread 100 when the thread 100 and the first coupler 110 are coupled to each other.

Further, a pair of first protrusions 116 may be formed with a predetermined gap therebetween to improve sealing ability, and in this case, a pair of slits 103 may also be formed.

As shown in FIGS. 2A and 2B, the second coupler 120 is a part disposed in the downhole motor 10 and receiving power by being fastened to the second end portion of the thread 100. The second coupler 120 has the second coupling inlet 121 formed with a predetermined depth from the first end thereof to insert the thread 100 and has the second grooves 122 and the second close-contact surface 123 sequentially formed from the coupling inlet to the second end to correspond to the send end portion of the thread 100.

Accordingly, it is possible to couple the thread 100 to the second coupler 120 by inserting the second end portion of the thread 100 into the second coupler 120 through the second coupling inlet 121, in which the contact portions 101 come in close contact with the second close-contact surface 123 and the ridges 102 are fitted to the second grooves 122 by the external shape of the thread 100 and the internal shape of the second coupling portion 120 described above.

A second stopping step 124 corresponding to the first stopping step 115 is also formed at the board between a second groove 122 and the second close-contact surface 123 in the second coupler 120 to lock the ridges 102 of the thread 100. Accordingly, the second end portion of the thread 100 inserted in the second coupler 120 is positioned at the end of the second coupler, but is not exposed out of the second coupler 120.

That is, as described above, since the first end portion of the thread 100 is inserted to a predetermined depth in the first coupler 110, but the second end portion is inserted to the same position as the end of the second coupler 120 through the second coupler 120, an outlet for discharging mud is not specifically formed at the second coupler 120, as compared with that the mud inlet 111 into which mud can flow is formed at the first coupler 110.

As described above, since the contact portion 101 having the same areas are respectively formed on both end portions of the thread 100, the length and area of the second close-contact surface 123 formed in the second coupler 120 should be the same as the length and area of the first close-contact surface 112, but the ridges 102 on both end portions of the thread 100 are not necessarily the same in area. Accordingly, the length and area of the second grooves 122 may be the same as or different from the length and area of the first grooves 113 and the length and area of the second coupling inlet 121 may also be the same as or different fro the length and area of the first coupling inlet 114.

A second circular protrusion may be formed toward the second coupling inlet 121 at the second stopping step 124, the same way as the first stopping step 115, and a slit 103 in which the second protrusion can be fitted may be formed on a groove 102 at the second end portion of the thread 100 to correspond to the second protrusion.

Accordingly, when the thread 100 is fastened to the second coupler 120, the second protrusion is fitted into the slit 103, and this structure increases the fastening force between the thread 100 and the second coupler 120 and further improves the sealing ability for the thread 100.

That is, close contact between the contact portion 101 and the second close-contact surface 123, the second stopping step 124, and the structure in which the second protrusion is fitted in the slit 103 are factors that triply improve the sealing ability for the thread 100 when the thread 100 and the first coupler 120 are coupled to each other.

In this configuration, a pair of second protrusions may be formed with a predetermined gap therebetween to improve sealing ability, and in this case, a pair of slits 103 may also be formed.

The embodiments described above are provided as examples so that the spirit of the present invention can be sufficiently communicated to those skilled in the art, and the present invention may be implemented in other ways without being limited to the embodiments.

Parts not related to description were omitted in the drawings to clearly describe the present disclosure and the width, length, thickness, etc. of components may be exaggerated or reduced in the drawings for convenience.

Like reference numerals indicate the same components throughout the specification.

Although the present invention was provided above in relation to specific embodiments shown in the drawings, it is apparent to those skilled in the art that the present invention may be changed and modified in various ways without departing from the scope of the present invention, which is described in the following claims.

The invention claimed is:

1. A downhole motor having an improved thread fastening structure to be used for drilling at an oil field, the downhole motor comprising:

a thread having a hole therein formed through a first end and a second end and having ridges formed on outer surfaces of a first end portion and a second end portion at predetermined distances respectively from the first end and the second end;

a first coupler having a mud inlet formed with a predetermined depth from a first end, having a first close-contact surface and first grooves that are sequentially formed from the inlet to correspond to the first end portion of the thread, and having a first coupling inlet formed from the first grooves to a second end to insert the thread therein; and a second coupler having a second coupling inlet formed with a predetermined depth from a first end to insert the thread therein, and having second grooves and a second close-contact surface sequentially formed from the second coupling inlet to a second end to correspond to the second end portion of the thread.

2. The downhole motor of claim 1, wherein the thread is a National Pipe Taper (NPT) thread.

3. A downhole motor of claim 1, wherein a first stopping step to which the ridges of the thread are locked is formed on a border between the first close-contact surface and the first grooves, and a second stopping step is formed at a board between the second grooves and the second close-contact surface in the second coupler to lock the ridges of the thread.

4. The downhole motor of claim 3, wherein a first protrusion is formed toward the first coupling inlet at the first stopping step, a second protrusion is formed toward the second coupling inlet at the second stopping step, and slits in which the first protrusion and the second protrusion are respectively fitted are formed respectively at both end portions of the thread.

* * * * *